US006227732B1

(12) United States Patent
Higuchi et al.

(10) Patent No.: US 6,227,732 B1
(45) Date of Patent: May 8, 2001

(54) SHEET PACKAGE AND PRINTER IN WHICH SHEETS ARE SET BY THE SHEET PACKAGE

(75) Inventors: Ken Higuchi; Hiroshi Katsuno; Masahide Fujita, all of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/156,035

(22) Filed: Sep. 17, 1998

(30) Foreign Application Priority Data

Sep. 19, 1997 (JP) ..... 9-254926

(51) Int. Cl.[7] ..... B41J 13/10; B65H 1/00; B65D 85/00

(52) U.S. Cl. ..... 400/624; 271/145; 206/449

(58) Field of Search ..... 400/624, 708; 206/449; 271/145, 162, 164

(56) References Cited

U.S. PATENT DOCUMENTS 3,651,933 * 3/1972 Bell ..... 206/449
3,727,823 * 4/1973 Sullivan ..... 206/449
4,085,884 * 4/1978 Hogenett et al. ..... 271/145
4,555,213 * 11/1985 Tamura et al. ..... 414/412
4,876,706 * 10/1989 Tajima ..... 378/174
5,067,835 * 11/1991 Yamamoto et al. ..... 271/145
5,137,269 * 8/1992 Yamamoto ..... 271/145
5,314,179 * 5/1994 Oda et al. ..... 206/449
5,690,329 * 11/1997 Van Peteghem et al. ..... 400/708
5,806,844 * 9/1998 Bailey et al. ..... 271/145

* cited by examiner

*Primary Examiner*—Stephen R. Funk
(74) *Attorney, Agent, or Firm*—Malcolm B. Wittenberg

(57) ABSTRACT

A sheet package according to the present invention is formed of a synthetic resin sheet and designed in a square-cornered bag shape to have an outer shape corresponding to sheets and a height at which plural sheets are stacked. The sheet package thus constructed is supplied to a user in a state where plural sheets are beforehand stacked and accommodated in a sheet package and packed by a vinyl bag or the like by a sheet maker. Accordingly, the user merely opens the vinyl bag to set the sheets into a sheet tray of a printer by the sheet package.

12 Claims, 25 Drawing Sheets

FIG. 13A
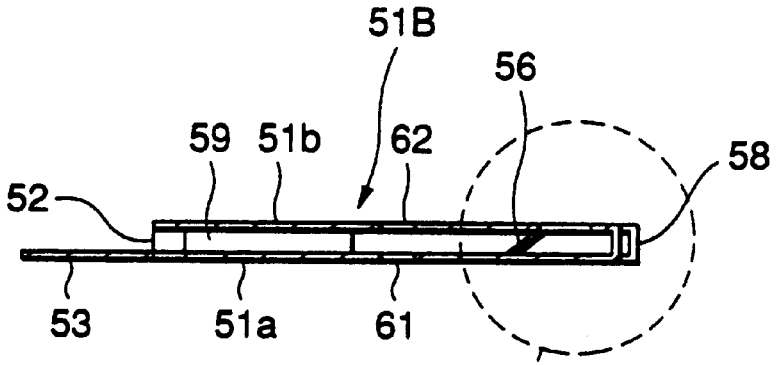
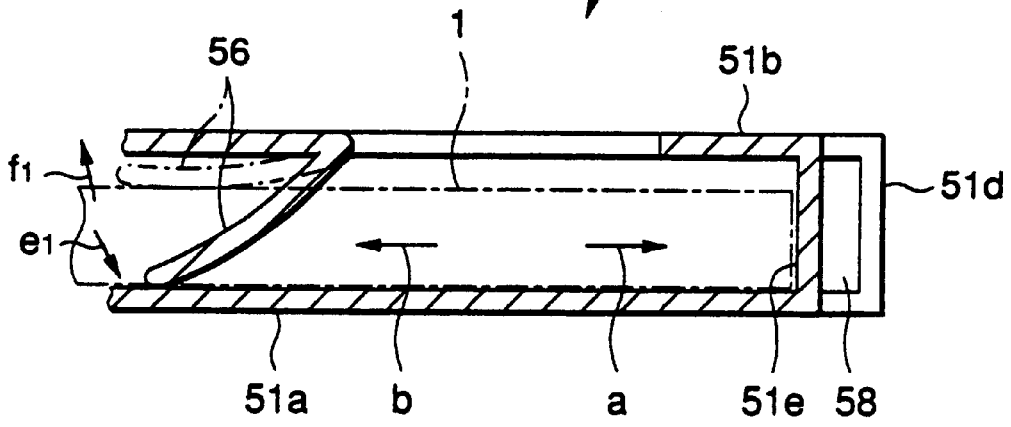
FIG. 13B

SHEET PACKAGE AND PRINTER IN WHICH SHEETS ARE SET BY THE SHEET PACKAGE

BACKGROUND OF THE INVENTION

The present invention relates to a sheet package which is most suitably applied to a printer, and a printer in which sheets are set by the sheet package.

In a conventional color printer such as a color video printer or the like, a color image picked up by a video camera or the like is printed on a photographic paper (i.e., sheet) according to a thermal transfer system using a thermal head, a platen and an ink ribbon. This type of printer is known as a sublimation type color printer in which three to four color dyes such as cyan, magenta, yellow, black or the like are thermally transferred onto a sheet by sublimation, and which are then fused. The photographic paper is selected in accordance with the type of the color printer. A special sheet whose surface is low in friction coefficient and glossy so that it is very slippery and also which is weighty, is used as photographic paper used in any color printer. As in the case of a general FAX and a copying machine, 50 to 100 sheets of photographic paper are inserted into a sheet feed tray in a stacked state, and then set (loaded) into a color printer.

Photographic paper used in these types of color printers is packed every 100 sheets while the sheets are stacked in a vinyl bag. When a user sets the packed sheets into the color printer, the user opens the vinyl bag to take out the sheets of the photographic paper therein while the sheets are left stacked, and inserts the sheets into a sheet feed tray. However, since the photographic paper sheets are very slippery and weighty, the photographic paper sheets are simply dispersed or fall down onto the floor or the like if the holding balance of the photographic paper sheets by hands is even slightly broken during the setting work of the photographic paper sheets. If these sheets fall down onto the floor or the like, the image quality and the grade after printing is completed are remarkably deteriorated due to scratches on the surface of the photographic paper or attachment of dust or the like to the photographic paper. Accordingly, in the sheet setting work of the photographic paper, the photographic paper cannot be roughly handled unlike the sheet set work in a general FAX or copying machine, and the user must carry out the sheet set work of the photographic paper with the greatest possible care so that no scratch is made on the surface of the photographic paper or dust or the like is attached to the photographic paper. Therefore, the set work of the photographic paper imposes very large labor to users. Further, since it is necessary to select the type of the photographic paper in accordance with the type of the color printer, the user must visually confirm the type of the photographic paper in the set work of the photographic paper at any time, and this is very cumbersome.

SUMMARY OF THE INVENTION

The present invention has been implemented in order to overcome the above problem, and has an object to provide a sheet package which facilitates a sheet set work of setting sheets into a color printer or the like, and a printer using the sheet package.

In order to attain the above object, according to a first aspect of the present invention, a sheet package in which sheets to be printed are accommodated has an outer shape which is matched with the shape of the sheets, a height at which a plurality of sheets can be stacked in the sheet package, and an outlet/inlet port through which the sheets are inserted when the sheets are accommodated in the sheet package, and taken out when a print operation is performed on the sheets, wherein the sheets are fed to a printer while accommodated in the sheet package.

The sheet package may further comprise a sheet backside insertion preventing pawl for preventing the sheets from being inserted from the backside of the sheet package.

The sheet package may further comprise a sheet type identifying code displayed thereon.

The sheet package may further comprise erroneous insertion preventing means for preventing the sheet package from being erroneously inserted into the printer.

The sheet package may be provided with a flexible portion which is flexible in only one direction and formed at the substantial center portion of the sheet package in a sheet insertion direction.

The sheet package may further comprise a sheet presence/absence identifying hole.

The sheet package may further comprise a sheet positioning hole for the printer.

The sheet package may further comprise a sheet outlet/inlet guide piece which is formed on the lower surface of a sheet outlet/inlet port of the sheet package.

According to a second aspect of the present invention, a printer having a sheet tray in which sheets are set together with a sheet package having an outer shape which is matched with the shape of the sheets, a height at which a plurality of sheets can be stacked in the sheet package; and an outlet/inlet port through which the sheets are inserted when the sheets are accommodated in the sheet package, and taken out when a print operation is performed on the sheets.

In the printer, the sheet package further comprises a sheet type identifying display, and a sensor for detecting the sheet type identifying display.

In the printer, the sheet package further comprises erroneous insertion preventing means for preventing the sheet package from being erroneously inserted into the printer. Further the sheet feed tray has an engaging portion which engages with the said erroneous insertion preventing means.

In the printer, the sheet package further comprises a flexible portion which is flexible in only one way at the substantial center portion of the sheet insertion direction, and the sheet feed tray further comprises a lift plate which lifts up the flexible portion.

In the printer, the sheet package further includes a sheet presence/absence judging hole, and a sensor for detecting the sheet presence/absence judging hole.

In the printer, the sheet package further includes a position defining hole in a sheet feed tray, and the sheet feed tray further includes a projection which is inserted into the position defining hole.

BRIEF DESCRIPTION OF THE DRAWINGS

FIGS. 13A and 13B are a cross-sectional view and a partially enlarged view showing the sheet package shown in FIG. 10, which is taken along a line I—I;

DETAILED DESCRIPTION OF THE PREFERRED EMBODIMENTS

Figure 1:
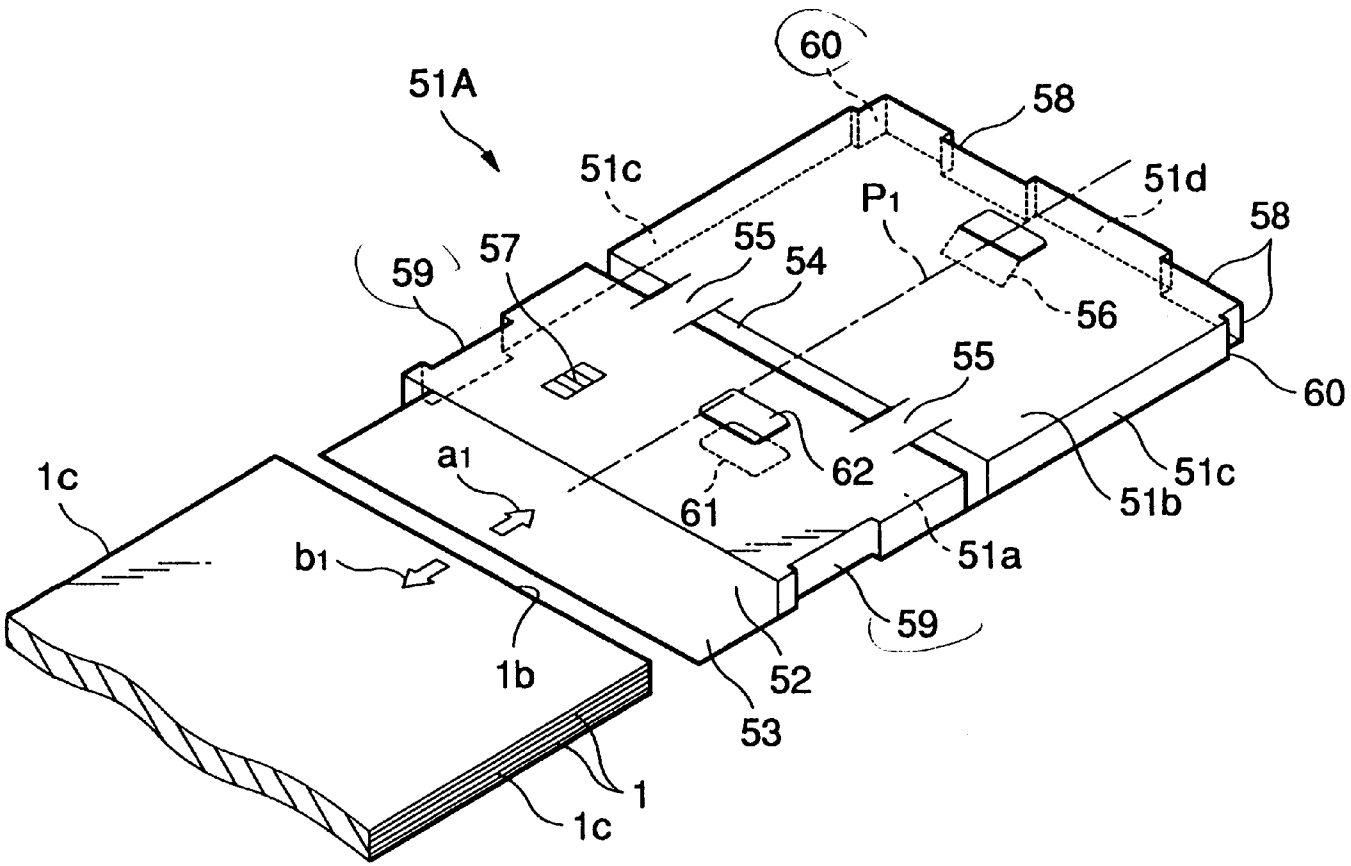
FIG. 1 is a perspective view showing a first embodiment of a sheet package according to the present invention.
Figure 2:
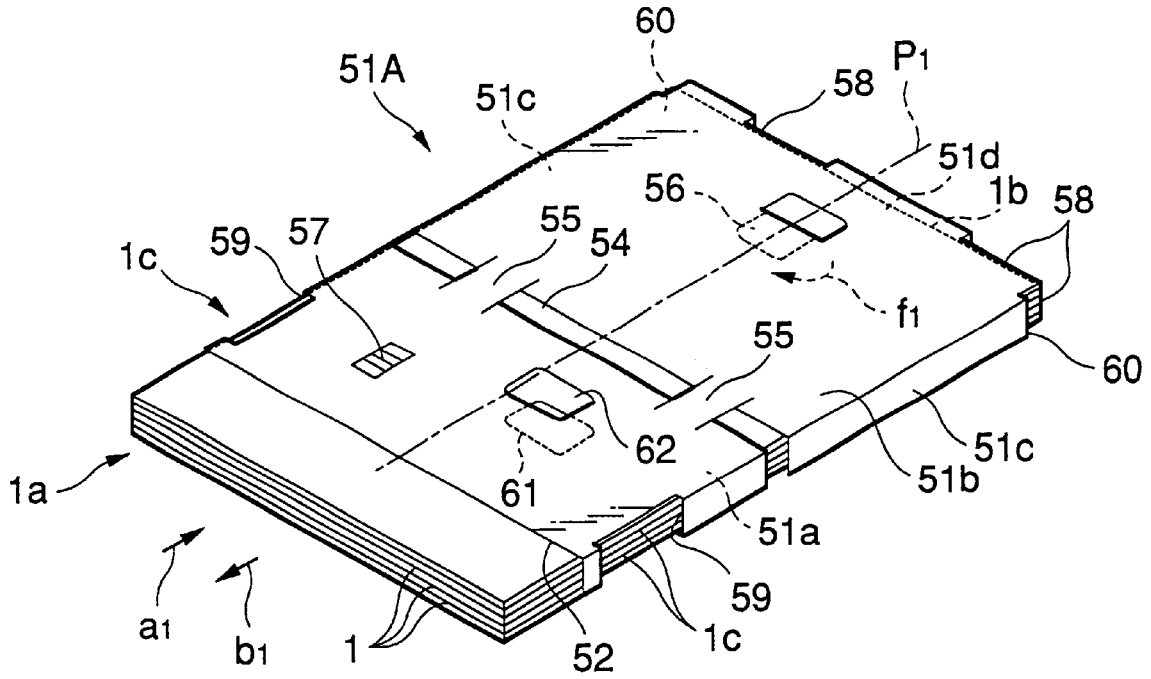
FIG. 2 is a perspective view showing a state where sheets are set in the sheet package shown in FIG. 1.
Figure 3:
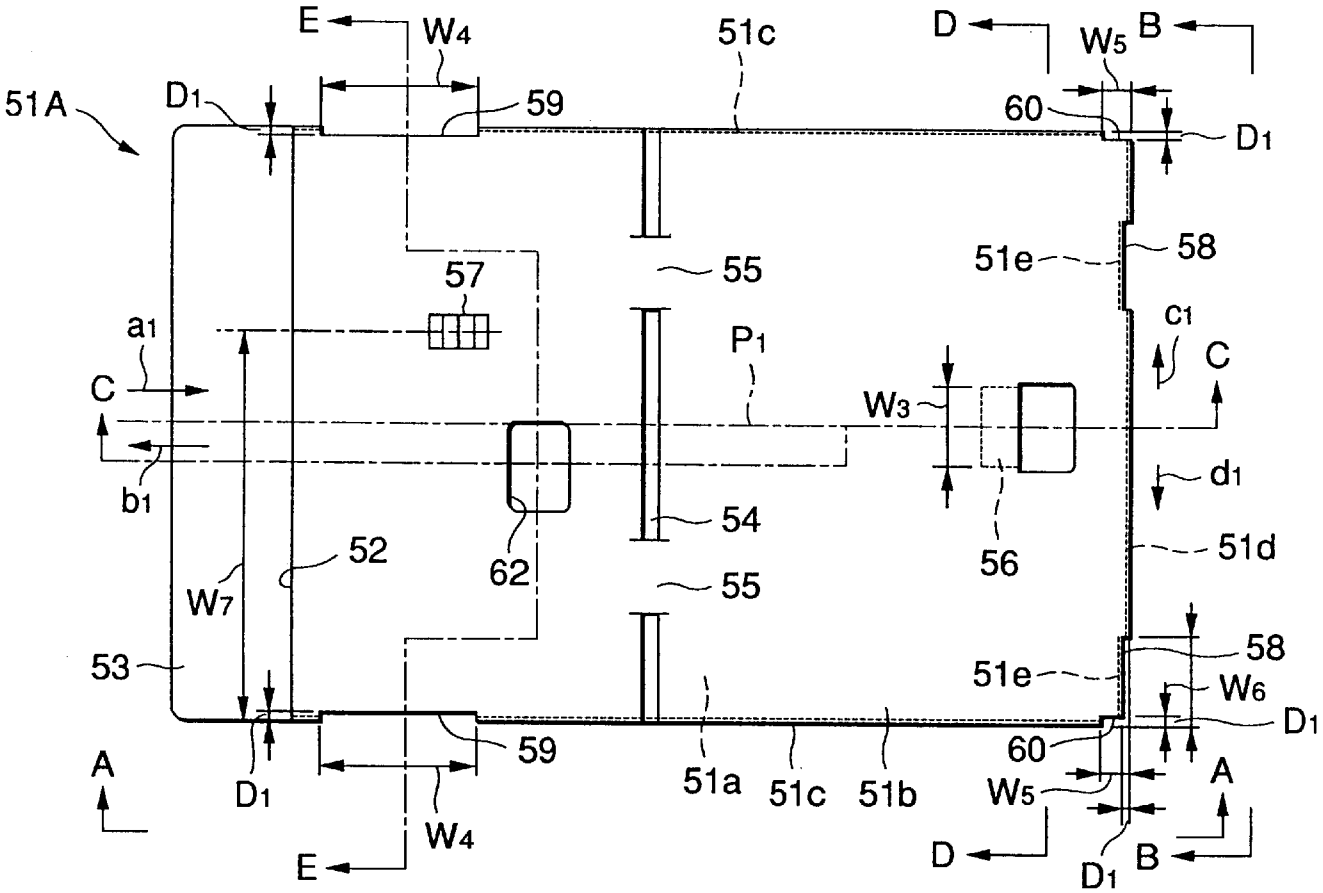
FIG. 3 is a plan view showing the sheet package shown in FIG. 1.
Figure 4A:
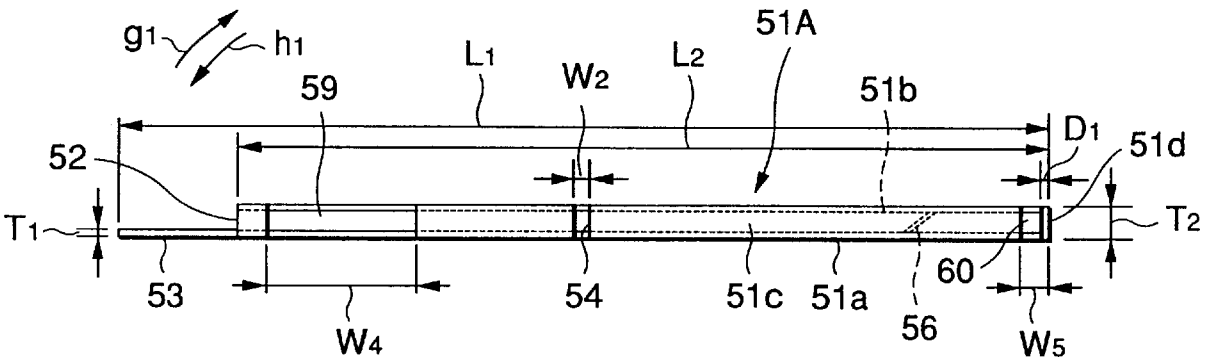
FIGS. 4*a* and 4*b* are side views showing the sheet package shown in FIG. 3, which is taken along a line A—A and a line B—B.
Figure 4B:
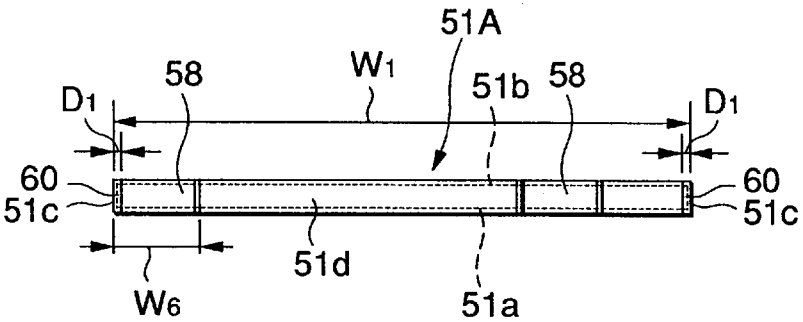

Preferred embodiments of a sheet package and a printer to which the present invention is applied will be described with reference to the accompanying drawings.

[First Embodiment of Sheet Package]

First, a sheet package 51A of a first embodiment of the present invention which accommodates photographic paper sheets 1 of A3 large-size used for a printer such as a color video printer or the like while 50 to 100 sheets are stacked will be described with reference to FIGS. 1 to 7.

The thickness $T_1$ of the sheet package 51A is equal to 0.4 mm or the like, and the sheet package 51A is designed in the form of a rectangular and square-cornered bag (shallow box type) by a synthetic resin sheet having proper rigidity such as a polypropylene sheet or the like, and it is blocked by five surfaces of a lower surface 51*a,* an upper surface 51*b,* right and left side surfaces 51*c* and a rear end surface 51*d.* A sheet outlet/inlet port 52 is formed at the front end surface side, and a sheet outlet/inlet guide piece 53 is formed integrally with the sheet package 51A so as to extend forwardly from the lower surface 51*a* of the sheet outlet/inlet port 52, a slit 54 is formed at the substantially center portion in the length (longitudinal) direction of the sheet package 51A (in the direction indicated by arrows $a_1$, $b_1$) over the upper surface 51*b* and the right and left side surfaces 51*c* so as to extend in the particular direction to the longitudinal direction of the sheet package 51A. Link pieces 55 having a small diameter are formed on the upper surface 51*b* so as to link two portions of the slit 54 in the length direction (the direction indicated by the arrows $a_1$, $b_1$) (i.e., so that the link pieces are bridged over the slit 54 at the two positions in the longitudinal direction of the sheet package 51A). With the slit 54 and the link pieces 55, the sheet package 51A is allowed to be bent (flexible) in only one direction (e.g., the upward direction).

Further, a sheet backside insertion preventing pawl 56 which is bent from the upper surface 51*b* of the sheet package 51A in the forward and downward direction is formed on the center line $P_1$ of the sheet package 51A in the longitudinal direction so as to be displaced to the rear end surface 51*d.* A sheet type identifying code 57 such as a light reflection type bar code or the like is displayed through an adhesive seal, print or the like at a position which is in the neighborhood of the sheet outlet/inlet port 52 and displaced to one side on the upper surface 51*b* of the sheet package 51A. The sheet backside insertion preventing pawl 56 is provided to prevent a user from erroneously inserting sheets whose type is different from that indicated by the sheet type identifying code 57.

Further, an erroneous insertion preventing notch 58 which constitutes erroneous insertion preventing means is formed on the rear end surface 51*d* of the sheet package 51A so as to be asymmetrical with respect to the center $P_1$. Respective pairs of right and left sheet positioning holes 59, 60 are formed at the positions displaced to the sheet outlet/inlet port 52 on the right and left surfaces 51*c* of the sheet package 51A and at the right and left corners of the rear end surface 51*d.* A pair of upper and lower sheet presence/absence judging holes 61, 62 are formed on the upper and lower surfaces 51*a,* 51*b* of the sheet package 51A so as to be slightly displaced toward the sheet outlet/inlet port 52 (in the longitudinal direction) with respect to the slit 54 and also slightly displaced to one side (in the particular direction to the longitudinal direction) with respect to the center $P_1$.

The sheet package 51A is constructed under the following dimensional conditions. That is, the total length (the length in the direction indicated by the arrows $a_1$, $b_1$) L=about 528 mm, the total width (the length in the direction indicated by arrows $c_1$, $d_1$) $W_1$=about 334 mm and the thickness $T_2$=about 14 mm. Further, the width $W_2$ of the slit 54 is equal to about 10 mm, the width $W_3$ of the sheet backside insertion preventing pawl 56 is equal to about 50 mm, the width $W_6$ and the depth $D_1$ of the erroneous insertion preventing notch 58 are equal to about 50 mm and about 46 mm, respectively, the width $W_4$ and the depth $D_1$ of the pair of right and left sheet positioning holes 59 of the sheet outlet/inlet port 52 side are equal to about 83 mm and about 4 mm, respectively, and the width $W_5$ and the depth $D_1$ of the pair of right and left sheet positioning holes 60 of the rear end surface 51*d* side are equal to about 19 mm and about 4 mm, respectively.

The sheet package 51A is constructed as described above. In a sheet maker, 50 to 100 stacked photographic paper sheets 1 are inserted from the sheet outlet/inlet port 52 inwardly in the direction indicated by the arrow $a_1$ to accommodate the photographic paper sheets in the sheet package 51A, and then the overall outer periphery of the sheet package 51A is packed in a vinyl bag (not shown) or the like and supplied to users.

Figure 5A:
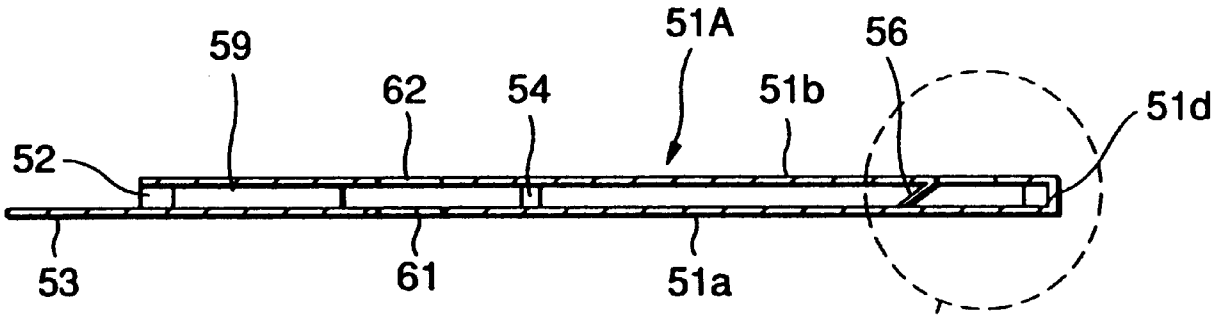
FIGS. 5A and 5B are a cross-sectional view and a partially enlarged view showing the sheet package shown in FIG. 3, which is taken along a line C—C.
Figure 5B:
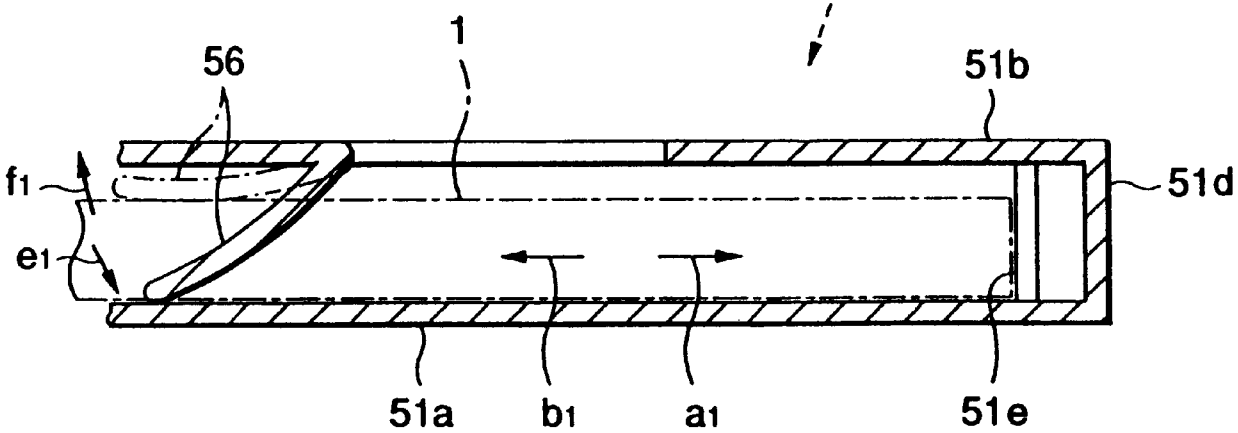
Figure 6:
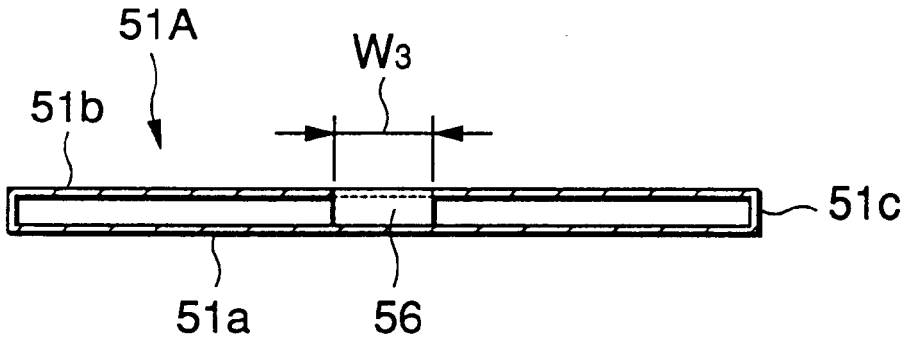
FIG. 6 is a cross-sectional view showing the sheet package shown in FIG. 3, which is taken along a line D—D.
Figure 7:
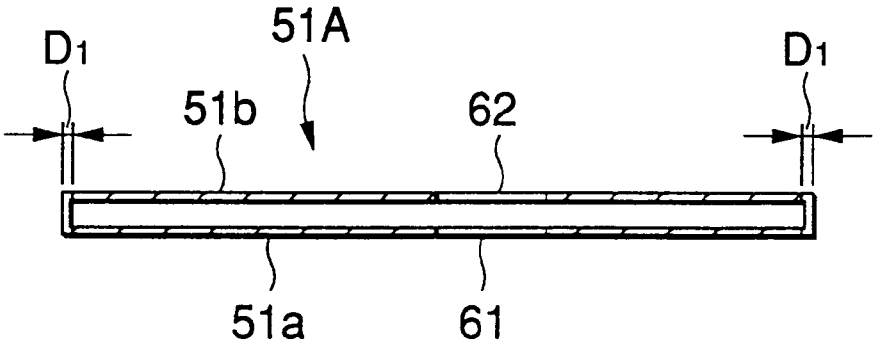
FIG. 7 is a cross-sectional view showing the sheet package shown in FIG. 3, which is taken along a line E—E.
Figure 8:
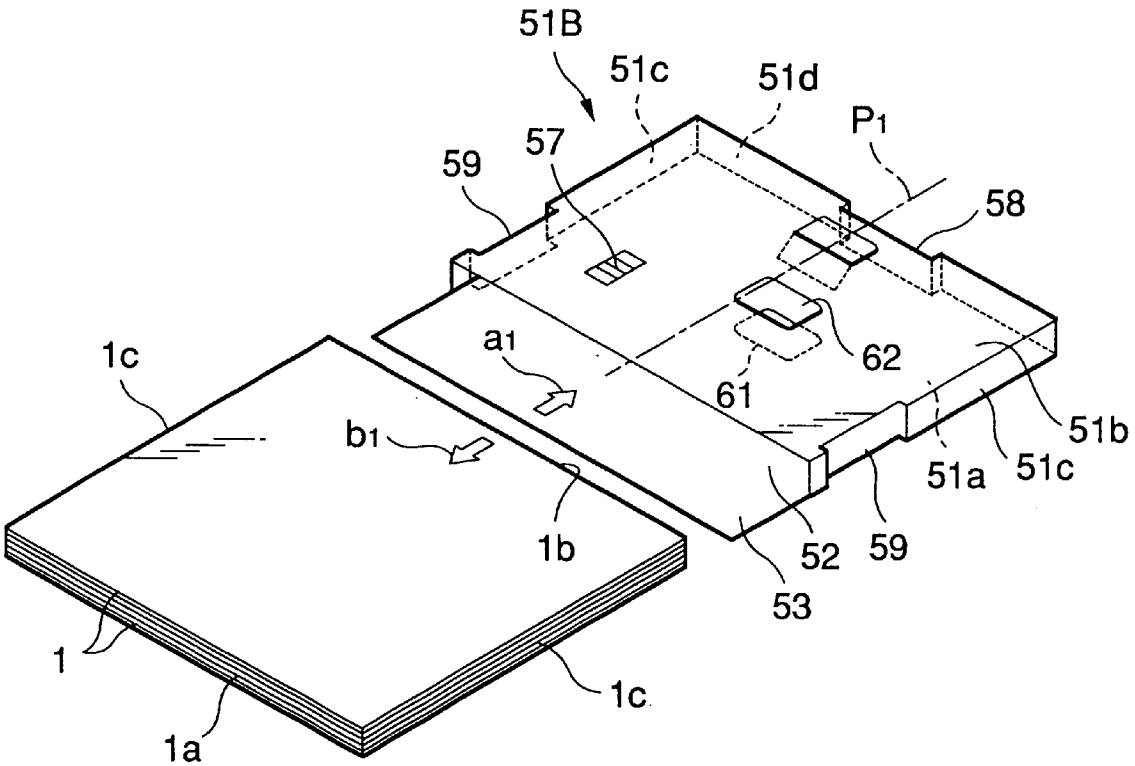
FIG. 8 is a perspective view showing a second embodiment of the sheet package according to the present invention.
Figure 9:
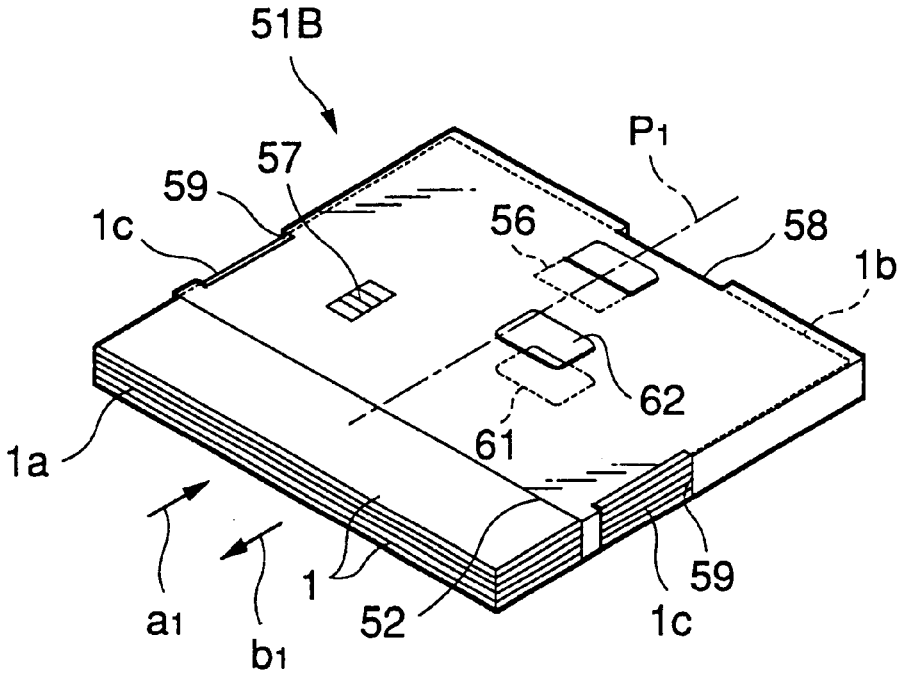
FIG. 9 is a perspective view showing a state where sheets are set in a sheet package shown in FIG. 8.
Figure 10:
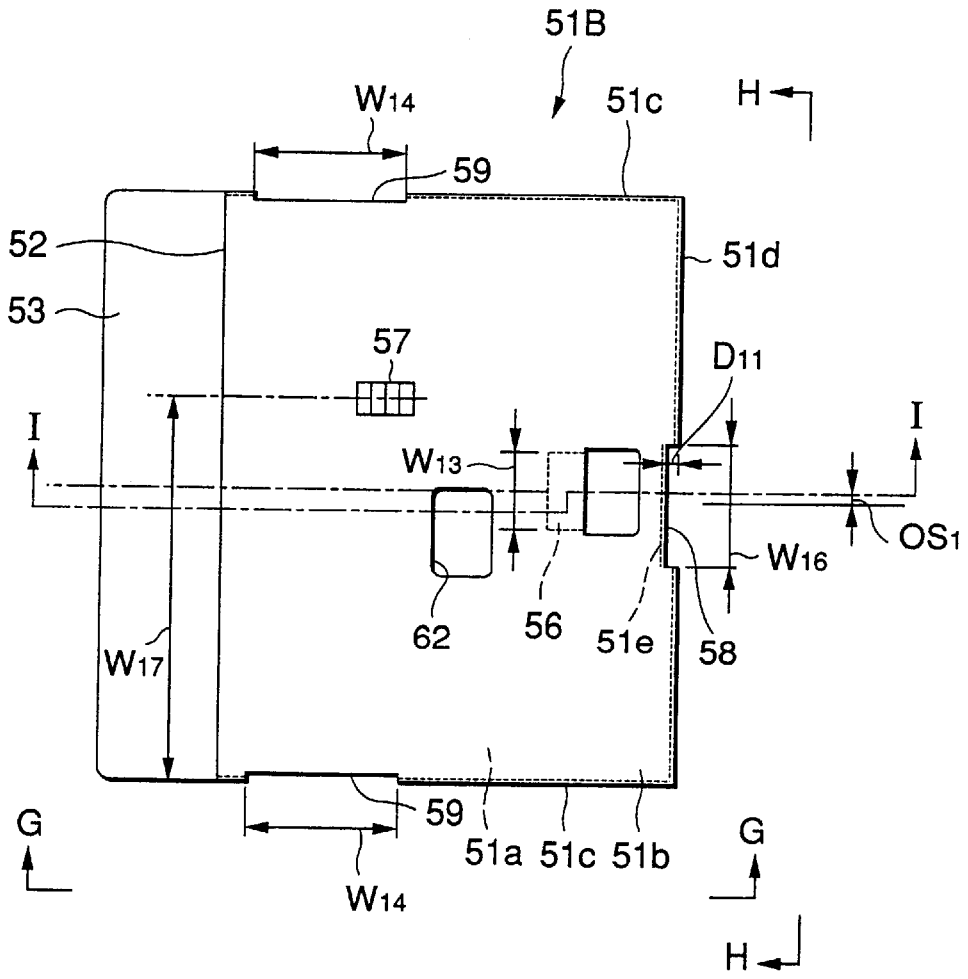
FIG. 10 is a plan view showing the sheet package shown in FIG. 8.
Figure 11:
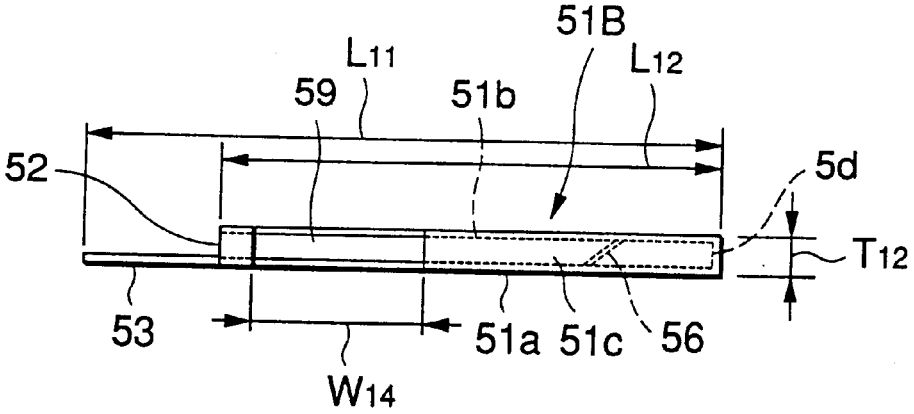
FIG. 11 is a side view showing the sheet package shown in FIG. 10, which is taken along a line G—G.
Figure 12:
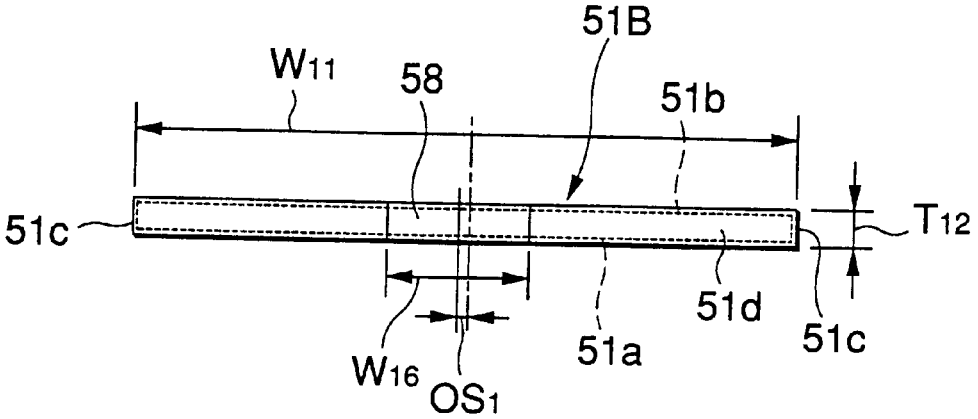
FIG. 12 is a side view showing the sheet package shown in FIG. 10, which is taken along a line H—H.
Figure 14:
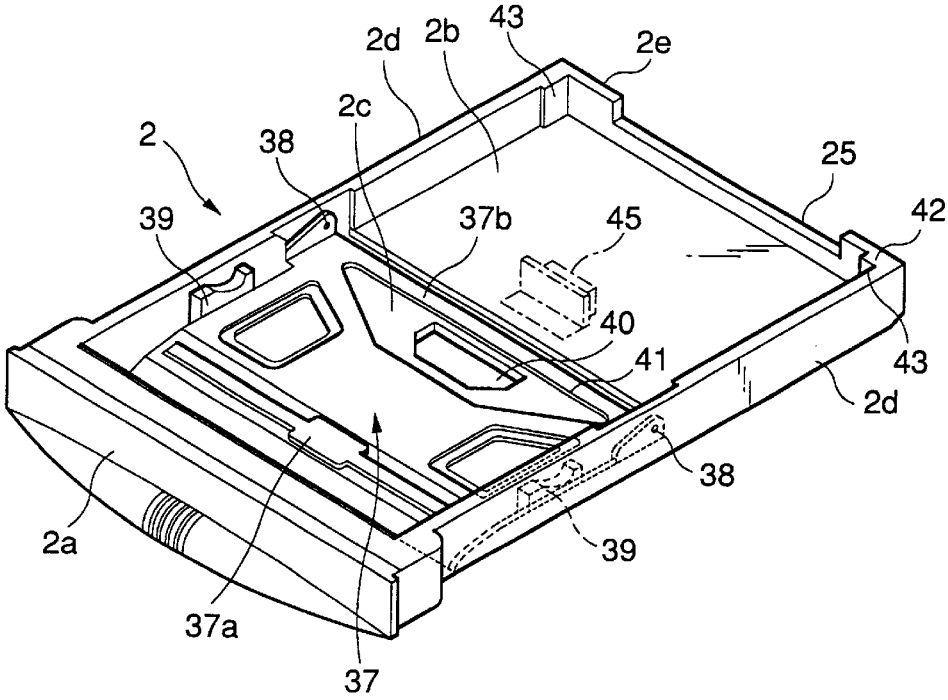
FIG. 14 is a perspective view showing a sheet feed tray to which the present invention is applied.
Figure 15:
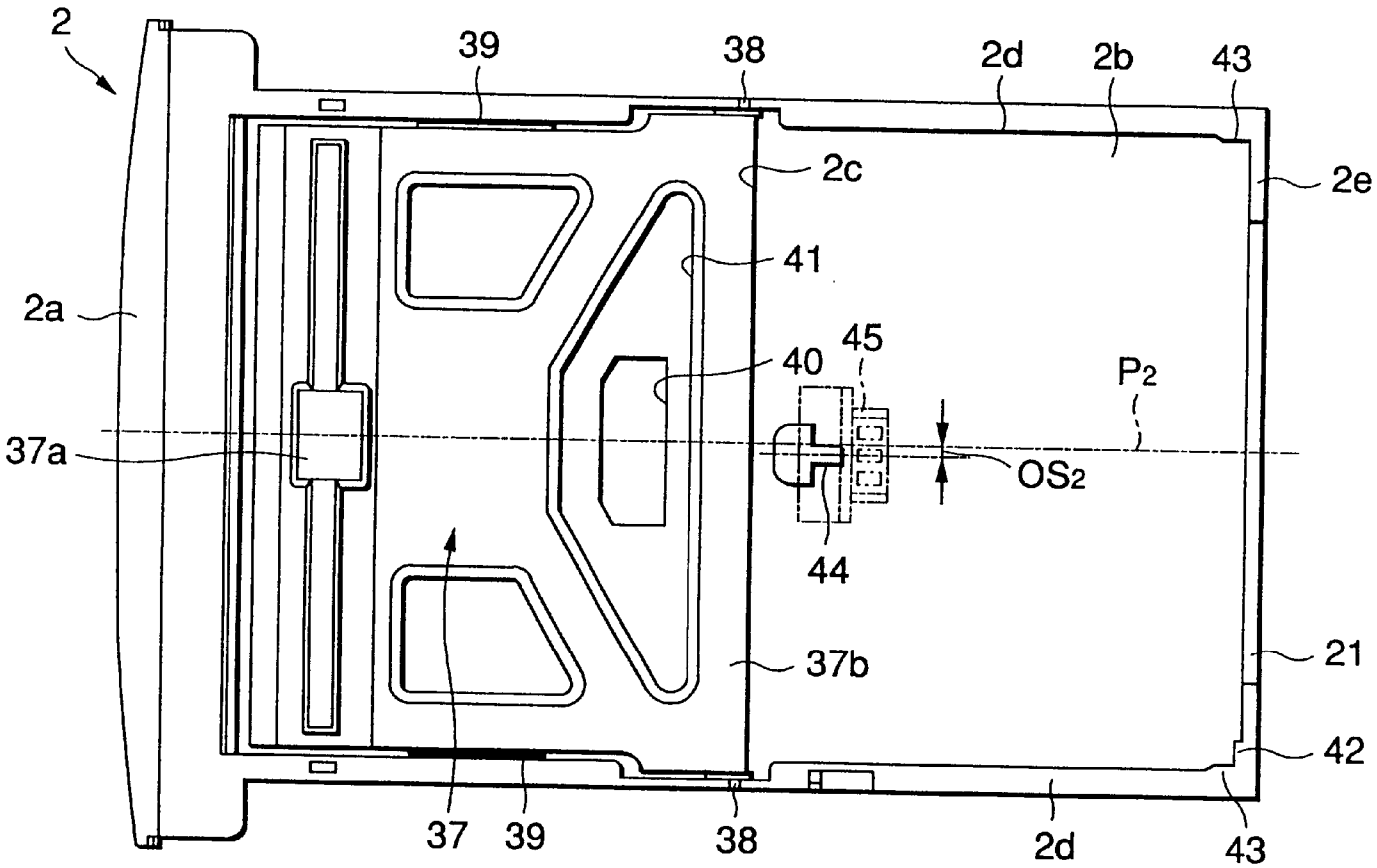
FIG. 15 is a plan view showing a sheet feed tray shown in FIG. 14.
Figure 16:
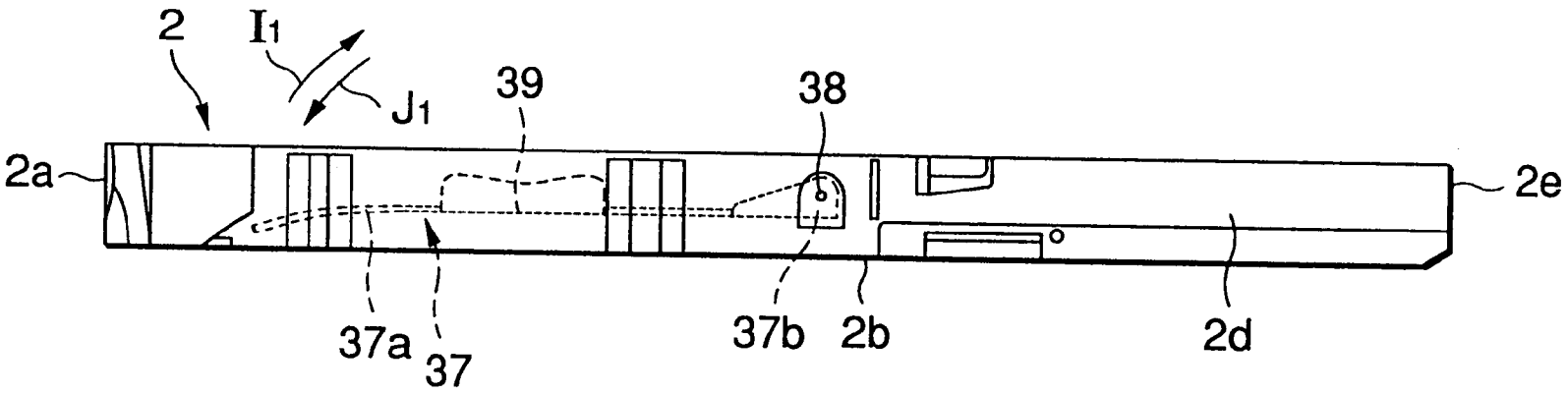
FIG. 16 is a side view showing the sheet feed tray shown in FIG. 14.
Figure 17:
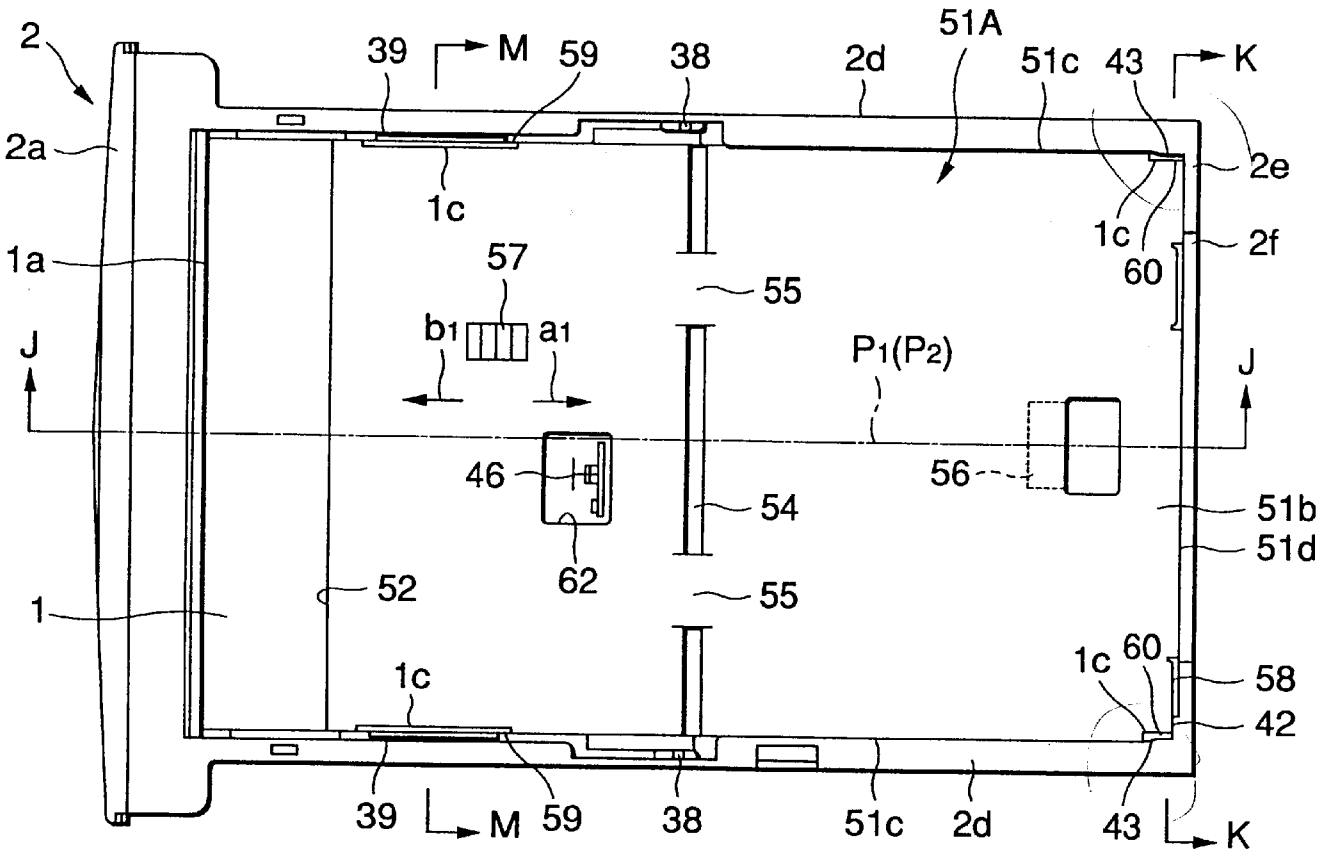
FIG. 17 is a plan view showing a state where one sheet package is set in the sheet feed tray shown in FIG. 14.

Before the photographic paper sheets are accommodated in the sheet package, the sheet backside insertion preventing pawl 56 is bent in the direction indicated by an arrow $e_1$ by elasticity thereof, and the photographic paper sheets 1 are accommodated in the sheet package 51A while the backside insertion preventing pawl 56 is bent in the direction indicated by an arrow $f_1$ against the elasticity thereof as shown by a one-dotted chain line in FIG. 5B. Further, when the photographic paper sheets are inserted into the sheet package 51A, the photographic paper sheets 1 can be guided by the sheet outlet/inlet port guide piece 53, so that the insertion of the photographic paper sheets 1 can be smoothly performed. The rear end surface 1*b* of the stacked photographic paper sheets 1 inserted in the sheet package 51A abuts against the stopper surface 51*e* formed at the inside of the rear end surface 51*d* to be positioned, and the photographic paper sheets 1 are exposed through the respective pairs of right and left sheet positioning holes 59, 60 to the outside at the right and left positions in the neighborhood of the sheet outlet/inlet port 52 on the right and left side surfaces 1*c* and at the right and left corners of the rear end surface 1*b* side.

[Second Embodiment of Sheet Package]

FIGS. 8 to 13 show a sheet package 51B according to a second embodiment of the present invention for accommodating 50 to 100 photographic paper sheets 1 of A4 large size used in a printer such as a color video printer while the sheets are stacked. The construction of the second embodiment is the same as the first embodiment except that the sheet positioning holes 60 at the right and left corners of the rear end surface 51*d* of the sheet package 51A are omitted. Further, the erroneous insertion preventing notch 58 is formed at a position which is offset by $OS_1$ to one side with respect to the center $P_1$ of the rear end surface 51*d*. The total length $L_{11}$ of the sheet package 51B is set to about 312 mm, the total width $W_{11}$ thereof is set to about 334 mm, and the thickness $T_{12}$ thereof is set to about 12 mm, and the dimensions of the other constituents are set to the same as those of the sheet package 51A.

[Embodiment of Sheet Feed Tray]

Next, an embodiment of a sheet feed tray 2 used in a printer such as a color video printer or the like will be described with reference to FIGS. 14 to 22.

That is, as well known, the sheet feed tray 2 is formed of synthetic resin. It comprises a front panel 2*a*, a bottom portion 2*b*, right and left side portions 2*d* and a rear end portion 2*e*, and is designed in a rectangular shallow box shape having an open upper portion. A recess portion 2*c* is formed in a front-side half space on the upper surface of the bottom portion 2*b*, and a sheet feed lift plate 37 formed by sheeting is mounted in the recess portion 2*c*.

The sheet feed lift plate 37 is secured at the right and left sides of the rear end side thereof to the inner walls of the right and left side portions 2*d* of the sheet feed tray 2 by a pair of coaxial and horizontal right and left support pins 38 respectively so as to be freely rotatable in the vertical direction. A pair of right and left sheet positioning pieces 39 which are designed so as to be erected substantially in U-shape are formed integrally with the sheet feed lift plate 37 at the right and left sides of the substantial center portion of the sheet feed lift plate 37 in the front-and-rear direction. Further, the sheet feed lift plate 37 is provided with a sensor insertion hole 41 which is overlapped with a sensor insertion hole 40 formed in the bottom portion 2*b* of the sheet feed tray 2, and other holes.

A notch 2*f* through which the sensor is penetrated is formed at the rear end portion 2*e* of the sheet feed tray 2, and an erroneous insertion preventing projection 42 serving as an engaging portion which is hooked to the erroneous insertion preventing notch 58 is integrally formed at one position of only the inside of the corner portion of one side portion 2*d* of the rear end portion 2*e*. A pair of right and left positioning projections 43 are integrally formed at the inside of the right and left corners of the rear end portion 2*e* of the right and left side portions 2*d* of the sheet feed tray 2. Further, a securing hole 44 is formed at a position which is adjacent to the sheet feed lift plate 37 on the upper surface of the sheet feed tray 2, and an erroneous insertion preventing piece 45 which is exclusively used for the sheet package 51B of A4 large size and serves as an engaging portion to be hooked into the erroneous insertion preventing notch 58 is detachably inserted into the securing hole 44.

The sheet feed tray 2 is constructed as described above. When a user sets photographic paper sheets 1 into the sheet feed tray 2 thus constructed, after a vinyl bag or the like of the sheet package 51A, 51B which is supplied while sheets are packed therein as described above is opened, the user can set the stacked photographic paper sheets 1 of 50 to 100 in the direction of the arrow $a_1$ (see FIG. 22) into the sheet feed tray 2 in a lump by using the sheet package 51A, 51B. Accordingly, since the stacked photographic paper sheets 1 of 50 to 100 can be set into the sheet feed tray 2 in a lump while accommodated in the sheet package 51A, 51B, there hardly occurs such a case that the photographic paper sheets 1 are scattered during the set work or fall down onto the floor or the like, and the photographic paper sheets 1 can be set into the sheet feed tray 2 simply and quickly.

FIGS. 17 to 20 show the state where the sheet package 51A is set in the sheet feed tray 2. When the sheet package 51A is set into the sheet feed tray 2 so that the erroneous insertion preventing notch 58 of the rear end surface 51*d* of the sheet package 51A is engaged with the erroneous insertion preventing projection 42 and the front side from the slit 54 is overlaid on the sheet feed lift plate 37, the pair of right and left sheet positioning pieces 39 of the sheet feed lift plate 37 are relatively inserted into the pair of right and left sheet positioning holes 59. Further, the pair of right and left sheet positioning projections 43 are relatively inserted into the pair of right and left sheet positioning holes 60, and the slit 54 is disposed between the pair of right and left support pins 38 of the sheet feed lift plate 37, whereby the sheet presence/absence detection holes 61, 62 are overlaid on the sensor insertion holes 40, 41.

Further, the right and left side surfaces 1*c* of the photographic paper sheets 1 in the sheet package 51A are positioned by the pair of right and left sheet positioning pieces 39 and the pair of right and left positioning projections 43, whereby the photographic paper sheets 1 can be accurately positioned onto the tray center $P_2$.

Figure 21:
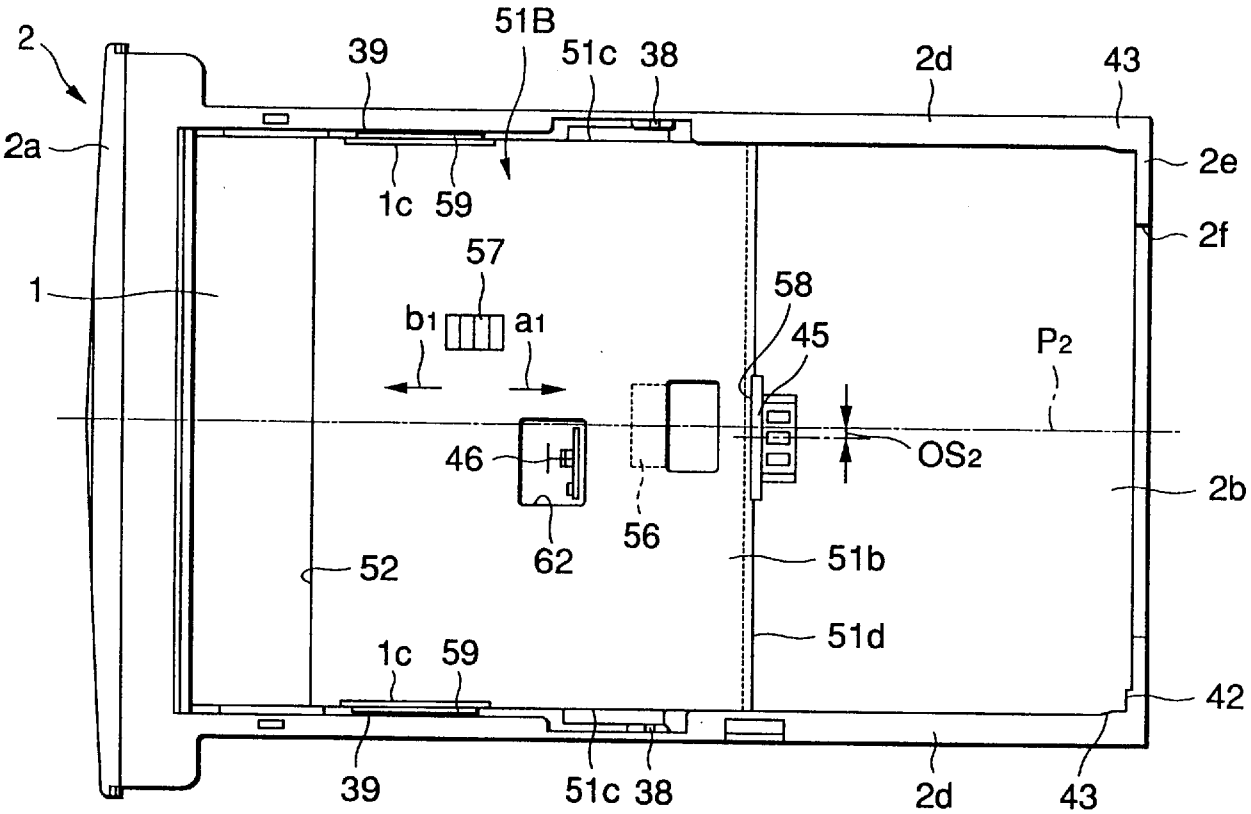
FIG. 21 is a plan view showing a state where another sheet package is set in the sheet feed tray of FIG. 14.
Figure 22:
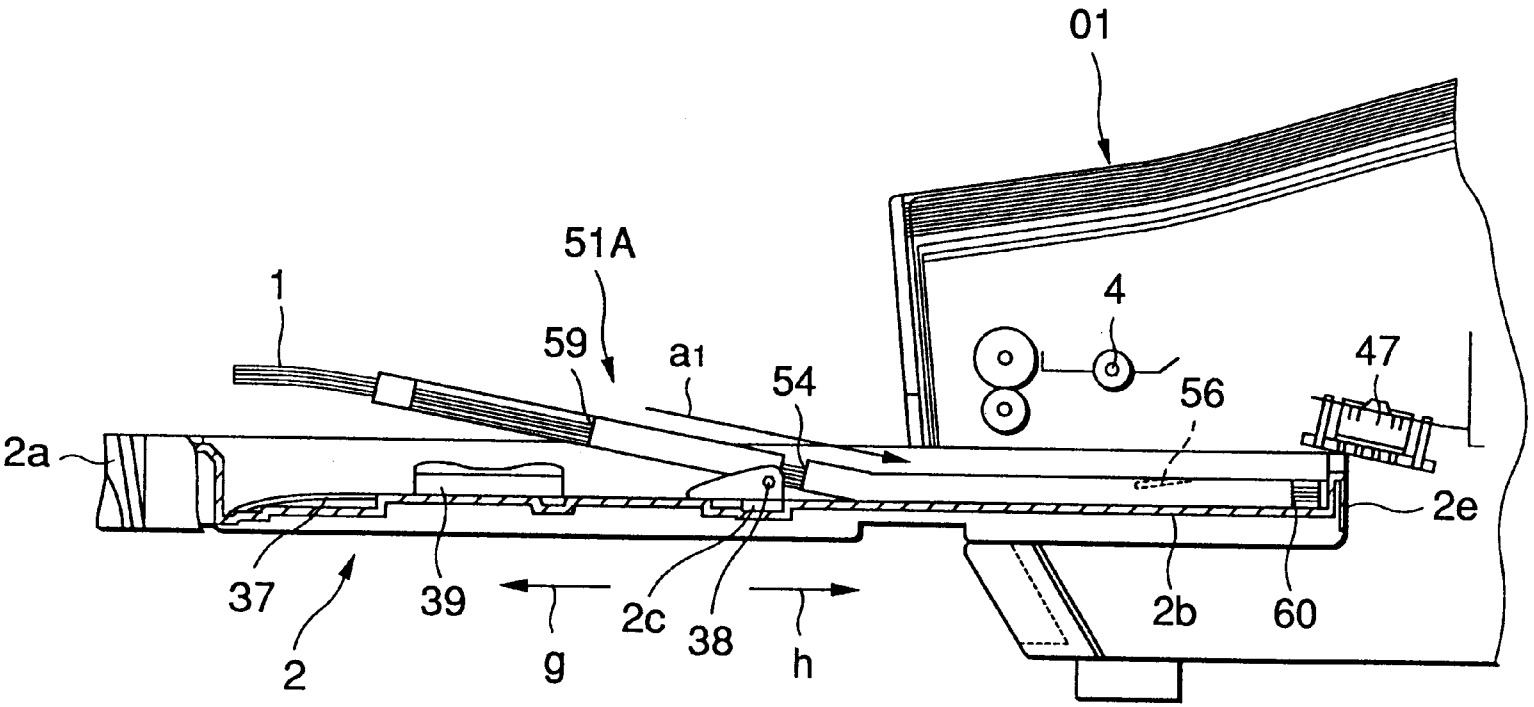
FIG. 22 is a cross-sectional view showing a set operation of the sheet package into the sheet feed tray of a color printer.
Figure 23:
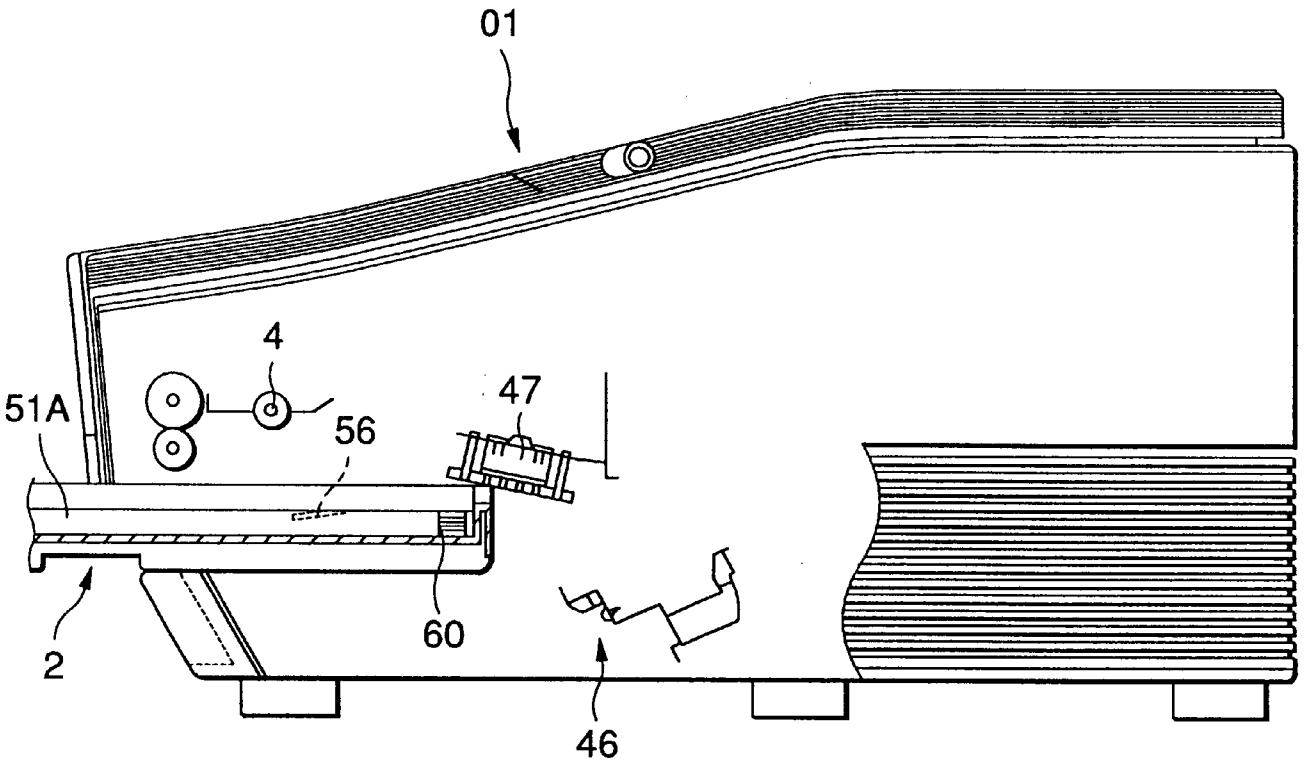
FIG. 23 is a partially notched side view showing an arrangement of a code sensor and a sheet presence/absence judging sensor in a color printer.

Further, FIG. 21 shows a state where the sheet package 51B is set in the sheet feed tray 2. In this case, the sheet package 51B is set to the front side of the erroneous insertion preventing member 45 while the erroneous insertion preventing member 45 is beforehand secured to the securing hole 44, and the erroneous insertion preventing notch 58 is engaged with the erroneous insertion preventing member 45. In this case, the same function as the case where the sheet package 51A is set is performed.

Figure 18A:
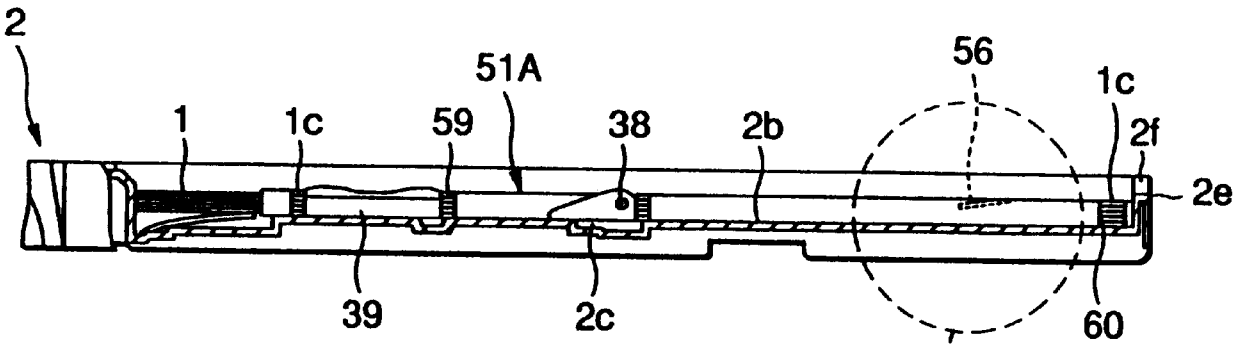
FIGS. 18A and 18B are a cross-sectional view and a partially enlarged view showing the sheet feed tray shown in FIG. 17, which is taken along a line J—J.
Figure 18B:
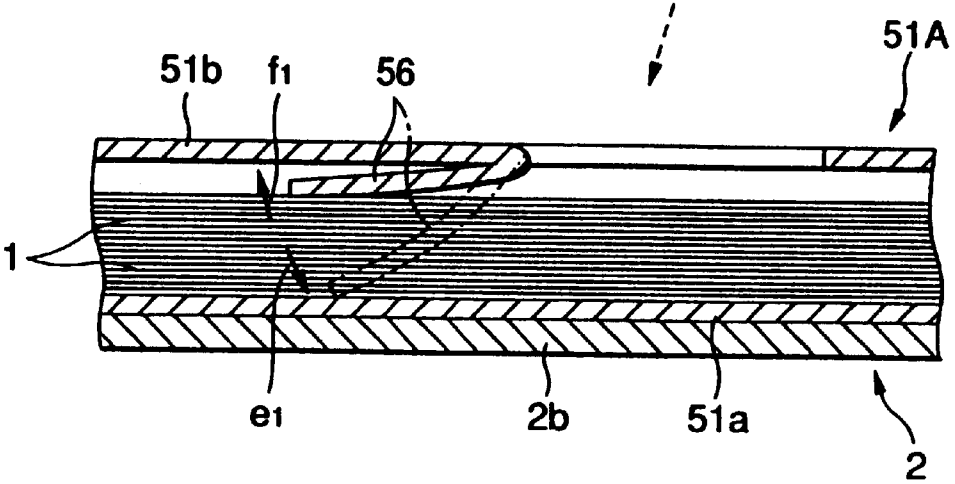
Figures 19A, 19B:
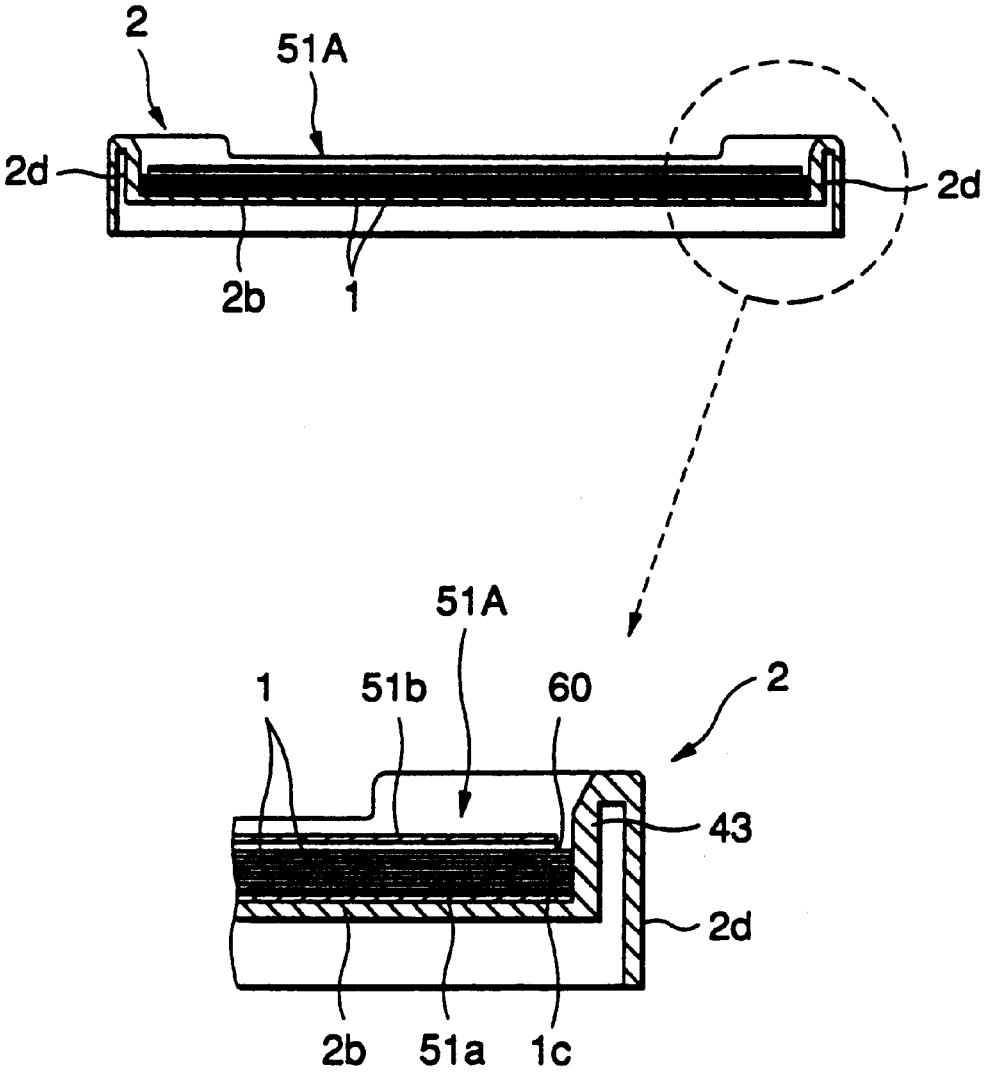
FIGS. 19A and 19B are a cross-sectional view and a partially enlarged view showing the sheet feed tray of FIG. 17, which is taken along a line J—J.
Figures 20A, 20B:
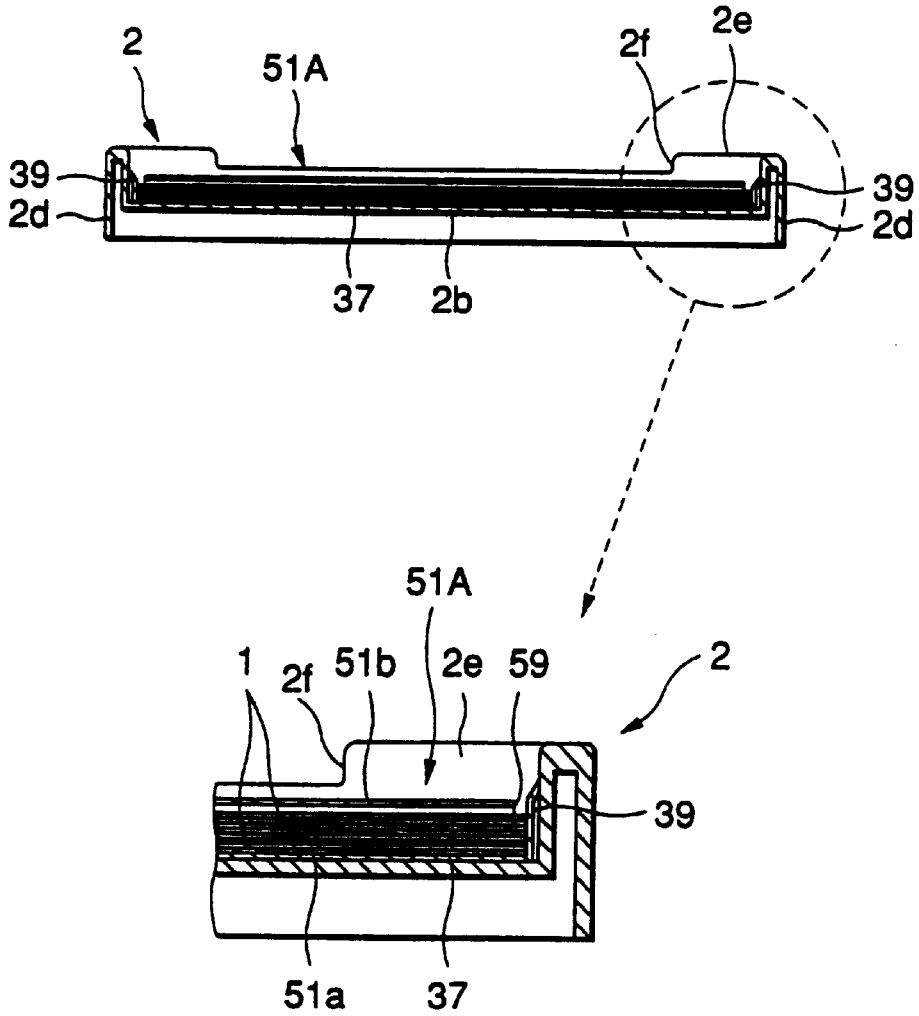
FIGS. 20A and 20B are a cross-sectional view and a partially enlarged view showing the sheet feed tray of FIG. 17, which is taken along a line M—M.

Accordingly, the sheet tray 2 is provided with the engaging portion of the erroneous insertion preventing notch 58 such as the erroneous insertion preventing projection 42, the erroneous insertion preventing member 45, etc., so that the erroneous insertion of the sheet package (for example, erroneous insertion in the front-and-rear direction, the right-and-left direction or the up-and-down direction) can be beforehand prevented when the sheet package 51A, 51B is set into the sheet tray 2. As shown in FIG. 18B, the sheet backside insertion preventing pawl 56 is provided to the sheet package 51A, 51B so as to be bent in the direction of the arrow $f_1$, so that even when a user erroneously inserts from the backside of the sheet package photographic paper sheets 1 whose type is different, the photographic paper sheets 1 abut against the sheet backside insertion preventing pawl 56 and thus they are prevented from being inserted. Therefore, the sheet back-side insertion operation by the user can be prevented in advance.

[Embodiment of Color Printer]

Next, a color printer 01 such as a color video printer or the like will be described with reference to FIGS. 22 to 27.

As shown in FIGS. 23 to 26, a code sensor 47 serving as a light reflection type sheet type identifying sensor for identifying the type of the photographic paper sheets 1 is slightly obliquely disposed at the front-and-upper side on the upper side of an inlet/outlet passage of the sheet feed tray 2 of the color printer 01, and the code sensor 47 is relatively moved in the notch 2*f* of the sheet feed tray 2 when the sheet feed tray 2 is inserted/taken out in the direction of an arrow g, h into/from the color printer 01.

Figure 26:
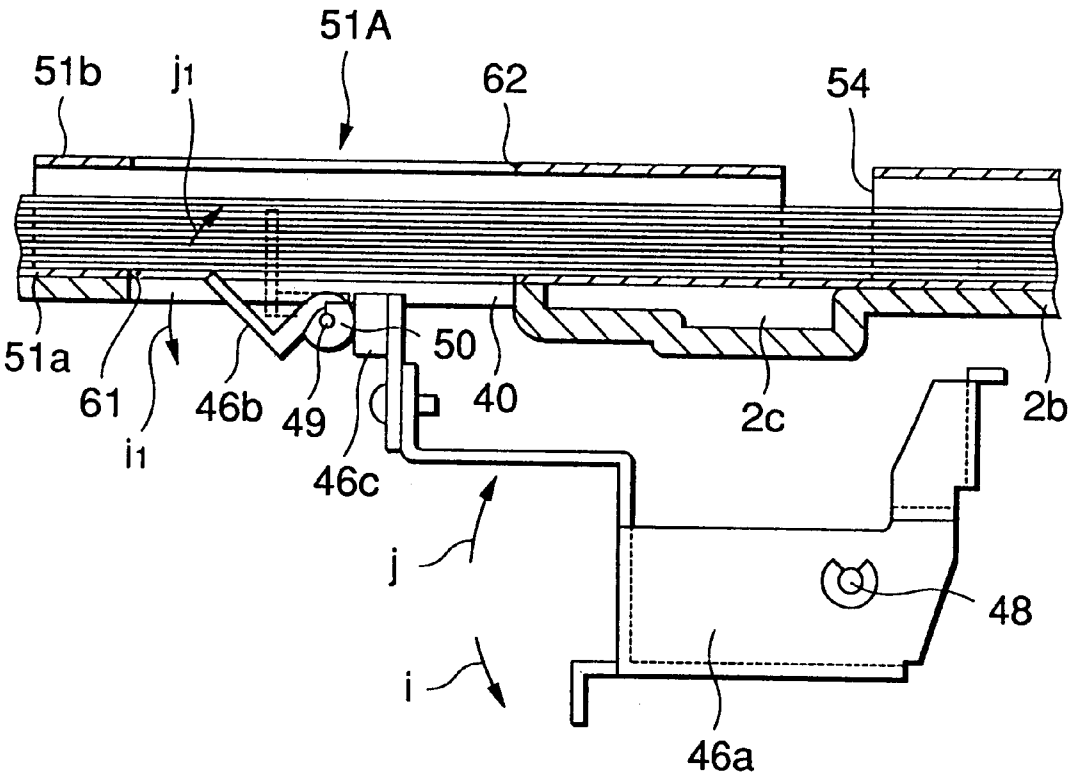
FIG. 26 is an enlarged cross-sectional view showing the sheet presence/absence judging sensor.

A sheet presence/absence judging sensor 46 is disposed at the lower side of the inlet/outlet passage of the sheet feed tray 2 of the color printer 01. As shown in FIG. 26, the sheet presence/absence judging sensor 46 has a two-staged structure comprising a sensor body 46*a* which is freely rotatably supported in the directions of arrows j, i which is the up-and-down direction around the support pins 48, and a sensor tip portion 46*b* which is freely rotatably secured to the tip of the sensor body 46*a* through the support pins 49 so as to be freely rotatable in the directions of arrows $j_1$, $i_1$ which are the up-and-down direction. The sensor tip portion 46*b* is rotationally urged in the direction of the arrow $j_1$ until a fixed angle relatively to the sensor body 46*a* by rotational urging means such as a torsion spring or the like. A photocoupler 46*c* serving as detection means for detecting the rotational position of the sensor tip portion 46*b* is secured to the tip of the sensor body 46*a*.

Figure 24:
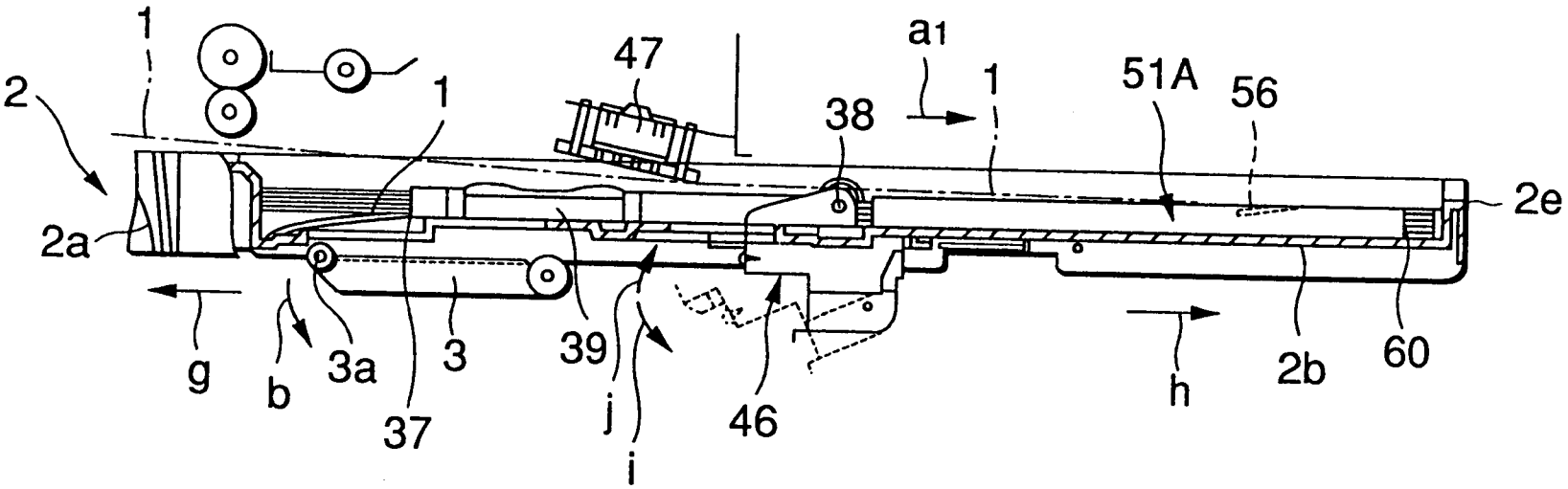
FIG. 24 is a cross-sectional view showing the relationship between the sheet feed tray set in the color printer and the code sensor and the sheet presence/absence judging sensor.

As indicated by a one-dotted chain line and a solid line in FIG. 24, the sheet feed tray 2 is inserted/taken out in the direction of the arrow g, h while the overall sheet presence/absence judging sensor 46 and the sheet feed lever 3 are rotated in the directions of the arrows i, b and retracted. As indicated by the solid line of FIG. 24, when the sheet feed tray 2 is set into the color printer 01, and the printing operation is started, the overall sheet presence/absence judging sensor 46 is first rotated in the direction of the arrow j, and as shown in FIG. 26 the sensor tip portion 46*b* is inserted from the sensor insertion hole 40, 41 into the sheet presence/absence judging hole 61 of the sheet package 51A, 51B. When there is photographic paper sheet 1 in the sheet package 51A, 51B, the sensor tip portion 46*b* abuts against the lower surface of the photographic paper sheet 1, and escapes in the direction of the arrow $i_1$ against the rotational urging means, whereby the photocoupler 46*c* detects the sheet presence. When no photographic paper sheet exists in the sheet package 51A, 51B, the sensor tip portion 46*b* is inserted to the deepest portion in the sheet package 51A, 51B and the escape of the sensor tip portion 46*b* in the direction of the arrow $i_1$ does not occur, so that the photocoupler 46*c* detects the sheet absence.

Figure 25:
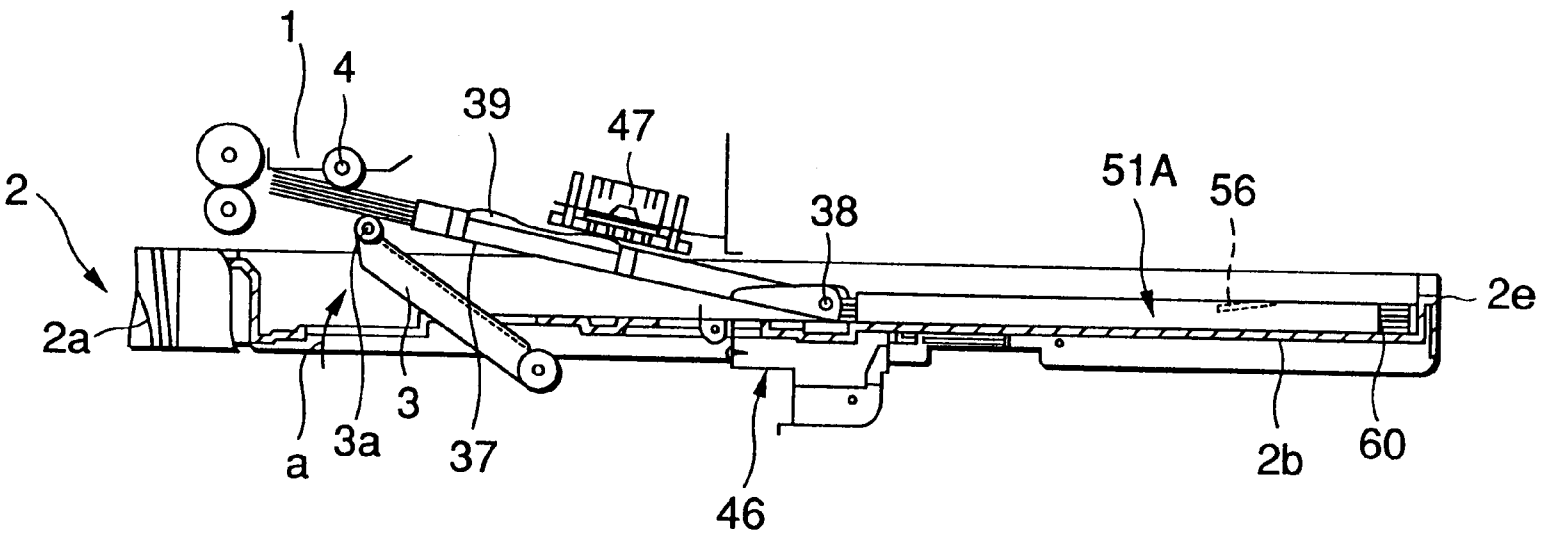
FIG. 25 is a cross-sectional view showing the operation of a sheet feed lever and the operation of the code sensor and the sheet presence/absence judging sensor in the color printer.

After the color printer 01 makes the above judgment of the sheet presence or absence, the sheet feed lever 3 is rotated in the direction of the arrow a (upwardly) as shown in FIG. 25, and the sheet feed lift plate 37 is pushed up in the direction of the arrow a by a roller 3*a* at the tip of the sheet feed lever 3. At this time, the sheet feed lift plate 37 is rotated in the direction of the arrow a around the pair of right and left support pins 38, and the front end side of the sheet package 51A is pushed up in the direction of the arrow a by the sheet feed lift plate 3, whereby the tip 1*a* of the photographic print sheet 1 at the top is pressed from the direction of the arrow a by the sheet feed roller 4 and also the sheet type identifying code 57 of the sheet package 51A is approached to the code sensor 47, so that the type of the photographic paper sheets 1 is automatically identified. At this time, the front end side of the sheet package 51A (the sheet outlet/inlet port 52 side) may be upwardly bent by the slit 54 of the sheet package 51A.

As indicated by the one-dotted chain line of FIG. 24, when the sheet feed tray 2 is set into the color printer 01 while the photographic paper sheets 1 are erroneously mounted on the upper portion of the sheet feed tray 2 by the user, as shown in FIG. 25, the erroneously-inserted photographic paper sheets 1 are approached to the code sensor 47 at the time when the front end side of the sheet package 51A is pushed up by the sheet feed lever 3, and the code sensor 47 cannot detect the sheet type identifying code 57 of the sheet package 51A, so that it is alarmed to the user that there is some trouble in the set state of the sheet package 51A.

Next, the print operation of a color image by the color printer 01 will be described with reference to FIG. 27.

[Description of Overall Sheet Feed]

That is, as described above, after 50 to 100 photographic paper sheets 1 which are stacked are set in a lump into the sheet tray 2 by the sheet package 51A, 51B, the photographic paper sheets 1 in the sheet feed tray 2 are lifted up by the sheet feed lever 3 and the uppermost photographic paper sheet 1 is pressed by the lower portion of the sheet feed roller 4 at the first stage, and the photographic paper sheet 1 is fed to the sheet feed passage 5 by the sheet feed roller 4. Thereafter, the photographic paper sheet 1 is fed in the direction of the arrow c along the sheet feed passage 5 to a printing device 11 by feeding means at second and subsequent stages such as a sheet feed belt 6, plural sheet feed rollers 7, etc. which are arranged along the sheet feed passage 5 while guided by plural sheet feed guides 9.

After the color image is printed on the photographic paper sheet 1 by a printing process of the printing device 11 as described later, the printed photographic paper sheet 1 is fed in the direction of the arrow f by feeding means at plural stages such as plural sheet discharging rollers 13, etc. which are arranged along a sheet discharging passage 12 while guided by plural sheet discharge guides 15, so that the photographic paper sheet 1 is discharged in the direction of the arrow f onto a sheet discharge stand formed at the upper portion of a case or the like of the set as indicated by a dotted line, whereby the print process of the color image for each photographic paper sheet is completed.

[Description of Printing Device and Print Operation of Color Image]

A small-diameter platen 21 is disposed in the printing device 11, and a pinch roller 22 having a diameter smaller than that of the platen 21 is disposed at the sheet feed side of the small-diameter platen 21. An ink ribbon 25 which is wound around a feed spool 23 and taken up by a take-up spool 24 is guided by plural guide rollers while suspended along the upper portion of the small-diameter platen 21, and a thermal head 27 is disposed at the upper side of the ink ribbon 25.

A chuck drum 28 is disposed at the sheet discharge side of the small-diameter platen 21, and a chuck mechanism is secured to the outer periphery of the chuck drum 28. In the print operation, the tip of the photographic paper sheet 1 is chucked to the outer periphery of the chuck drum 28, and then the ink ribbon 25 is pressed against the photographic paper sheet 1 on the small-diameter platen 21 by the thermal head 27. Thereafter, the ink ribbon 25 is intermittently taken up by the take-up reel 24, and in synchronism with the intermittent motion, the photographic paper sheet is intermittently taken out around the outer periphery of the chuck drum 28.

Figure 27:
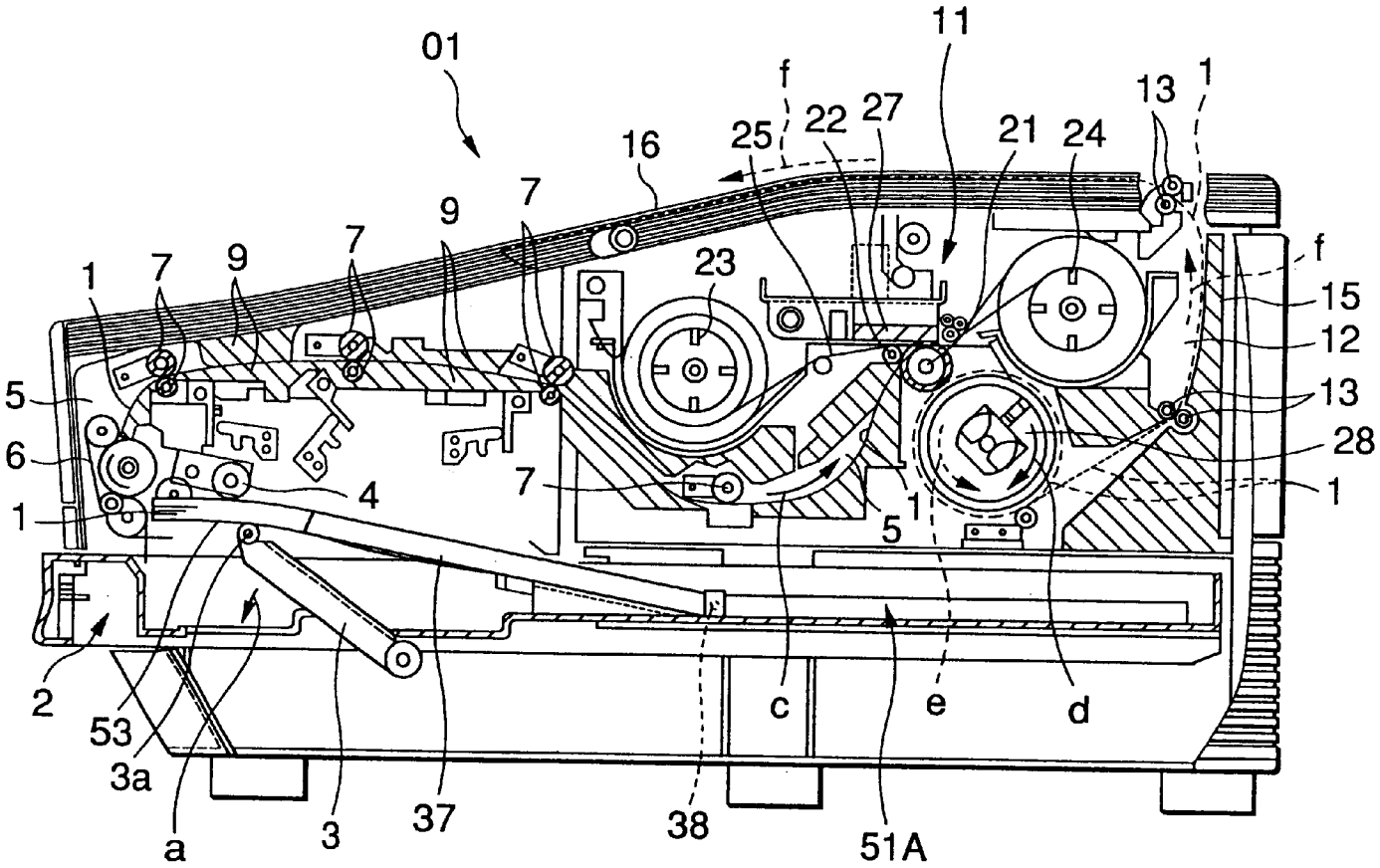
FIG. 27 is a cross-sectional view showing the color printer.

A color image of first color of the three to four colored sublimating materials of cyan, magenta, yellow, black or the like which are coated on the ink ribbon 25 is printed on the photographic paper sheet 1 according to the thermal printing system by the thermal head 27, and at the time when the print process of the first color is completed, the photographic paper sheet 1 is wound around the outer periphery of the chuck drum 28 at several times (about two to four times) as shown in FIG. 27.

In the print operation of a color image of second color, the thermal head 27 is separated upwardly from the small-diameter platen 21, and the chuck drum 28 and the small-diameter platen 21 is inversely rotated in the direction of the arrow e while the tip of the photographic paper sheet 1 is kept chucked to the chuck drum 28. In addition, the sheet feed rollers 7 at the plural stages of the sheet feed passage 5 are inversely rotated so that the photographic paper sheet 1 wound around the outer periphery of the chuck drum 28 is drawn back from the rear end side thereof to the first-color printing start position in the sheet feed passage 5.

At the time when the photographic paper sheet 1 is drawn back to the first-color print start position, the chuck drum 28 and the small-diameter platen 21 are stopped, and then the ink ribbon 25 is pressed against the photographic paper sheet 1 on the small-diameter platen 21 by the thermal head 27 again. Further, the chuck drum 28 and the small-diameter platen 21 are intermittently rotated in the direction of the arrow d again, and the print operation of the color image of the second color is performed in the same manner as described above while the ink ribbon 25 is intermittently taken out by the take-up reel 24 in synchronism with the intermittent motion of the chuck drum 28 and the small-diameter platen 21. The print operation of color images of the other color is repetitively performed to perform a full-color image printing operation based on totally three or four colors of cyan, magenta, yellow, black or the like.

After the print operation of the full color image is completed, the photographic paper sheet 1 is completely taken up in the direction of the arrow d by the chuck drum 28. After the rear end of the photographic paper sheet 1 is completely pulled out in the direction of the arrow c from the gap between the small-diameter platen 21 and the pinch roller 22, and then the chuck drum 28 is inversely rotated in the direction of the arrow e to feed the photographic paper sheet 1 from the rear end side thereof into the sheet discharge passage 2. The photographic paper sheet 1 thus fed is discharged in the direction of the arrow f along the sheet discharge passage 12. During the sheet discharge operation, the chuck mechanism of the chuck drum 28 is released to completely discharge the photographic paper sheet 1 from the rear end side thereof onto the sheet discharge stand 16 in the direction of the arrow f.

The present invention is not limited to the above embodiments, and various modifications may be made on the basis of the technical concept of the present invention. For example, a color video printer is used as an example of the printer to which the present invention is applied. However, the present invention may be applied to a printer needing the sheet feeding operation, such as an ink jet printer, a laser printer, an impact printer, etc. Further, the present invention may be applied to not only color printers but also various FAXes and copying machines.

What is claimed is:

1. A sheet package in which sheets to be printed are accommodated having:

an outer shape which is matched with the shape of the sheet;

a height at which a plurality of sheets can be stacked in said sheet package;

an outlet/inlet port through which the sheets are inserted when the sheets are accommodated in said sheet package, and taken out when a print operation is performed on the sheets, wherein the sheets are fed to a printer while accommodated in said sheet package and further wherein a portion which is flexible in only one direction is formed at the substantial center portion of said sheet package in a sheet insertion direction.

2. The sheet package as claimed in claim 1, further comprising a sheet backside insertion preventing pawl for preventing the sheets from being inserted from the backside of said sheet package.

3. The sheet package as claimed in claim 1, further comprising a sheet type identifying code displayed thereon.

4. The sheet package as claimed in claim 1, further comprising erroneous insertion preventing means for preventing said sheet package from being erroneously inserted into the printer.

5. The sheet package as claimed in claim 1, further comprising a sheet presence/absence identifying hole.

6. The sheet package as claimed in claim 1, further comprising a sheet positioning hole for the printer.

7. The sheet package as claimed in claim 1, further comprising a sheet outlet/inlet guide piece which is formed on the lower surface of said sheet outlet/inlet port.

8. A printer having a sheet tray in which sheets are set together with a sheet package having an outer shape which is matched with the shape of the sheets, a height at which a plurality of sheets can be stacked in said sheet package; and an outlet/inlet port through which the sheets are inserted when the sheets are accommodated in said sheet package, and taken out when a print operation is performed on the sheets and wherein said sheet package further comprises a flexible portion which is flexible in only one way at the substantial center portion of the sheet insertion direction, and said sheet feed tray further comprises a lift plate which lifts up said flexible portion.

9. The printer as claimed in claim 8, wherein said sheet package further comprises a sheet type identifying display, and said printer is provided with a sensor for detecting said sheet type identifying display.

10. The printer as claimed in claim 8, wherein said sheet package further comprises an erroneous insertion preventing means for preventing said sheet package from being erroneously inserted into said printer, and wherein said sheet feed tray is provided with an engaging portion which engages said erroneous insertion preventing means.

11. The printer as claimed in claim 8, wherein said sheet package further includes a sheet presence/absence judging hole, and said printer is provided with a sensor for detecting said sheet presence/absence judging hole.

12. The printer as claimed in claim 8, wherein said sheet package further includes a position defining hole, and said sheet feed tray further includes a projection which is inserted into said position defining hole.

* * * * *